US006981617B2

(12) United States Patent
Nakamura et al.

(10) Patent No.: US 6,981,617 B2
(45) Date of Patent: Jan. 3, 2006

(54) EXTRUSION CONTAINER

(75) Inventors: Hiroyuki Nakamura, Koto-ku (JP); Masashi Yoneyama, Matsudo (JP); Takayuki Goto, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 63 days.

(21) Appl. No.: 10/469,421

(22) PCT Filed: Nov. 29, 2002

(86) PCT No.: PCT/JP02/12494

§ 371 (c)(1),
(2), (4) Date: Sep. 24, 2003

(87) PCT Pub. No.: WO03/045804

PCT Pub. Date: Jun. 5, 2003

(65) Prior Publication Data

US 2004/0217128 A1 Nov. 4, 2004

(30) Foreign Application Priority Data

Nov. 30, 2001 (JP) ..... 2001-366726

(51) Int. Cl.
*B65D 37/00* (2006.01)

(52) U.S. Cl. ..... 222/215

(58) Field of Classification Search ..... 222/105, 222/107, 386.5, 478, 212, 215, 130, 131; 220/723

See application file for complete search history.

(56) References Cited

U.S. PATENT DOCUMENTS

| | | | | |
|---|---|---|---|---|
| 5,242,085 | A * | 9/1993 | Richter et al. | 222/105 |
| 5,332,121 | A * | 7/1994 | Schmidt et al. | 222/95 |
| 6,266,943 | B1 * | 7/2001 | Nomoto et al. | 53/410 |
| 6,742,676 | B2 * | 6/2004 | Nakamura et al. | 222/95 |
| 2001/0040173 | A1 * | 11/2001 | Yamamoto et al. | 222/106 |

* cited by examiner

*Primary Examiner*—Philippe Derakshani
(74) *Attorney, Agent, or Firm*—Oliff & Berridge, PLC

(57) ABSTRACT

An extrusion container comprises a main container body with a squeezable outer shell layer and an extrusion cap body, and at least two adhesive bands of longitudinal band form, each of which adheres and fixes together the outer shell layer and an inner layer along the entire height range, wherein the width of each adhesive band is set so as to disable complete closure of the plane cross section by free deformation of non-adhered inner layer parts, and a rigidity of the outer shell layer is set so that, in the state where free deformation of the non-adhered inner layer parts reaches a limit, deformation of the outer shell layer by tension at the non-adhered inner layer parts occurs as a result of normal squeezing operation by a human hand, whereby an extrusion path and smooth extrusion operation is maintained and residual contents is reduced.

12 Claims, 9 Drawing Sheets

EXTRUSION CONTAINER

TECHNICAL FIELD

This invention relates to in a separably laminated synthetic resin blow molded container, with which a deflatable inner container body is separably laminated inside a squeezable outer container body, a synthetic resin extrusion container with which use, that is, extrusion of the contents is facilitated.

BACKGROUND ART

Laid-open Japanese Utility Model Publication No. Sho 57-44063 and Laid-open Japanese Utility Model Publication No. Hei 7-22951 disclose squeeze-type extrusion containers that comprise an inner container body and an outer container body that contains the inner container body.

With the extrusion container disclosed in Laid-open Japanese Utility Model Publication No. Sho 57-44063, a ventilation hole is provided at the bottom part of a main container body so that after extrusion of contents by squeezing of the main container body, external air is introduced between an outer container body and an inner container body so that while keeping the deformed shape of the inner container body as it is, the main container body is returned by its restoring force to its original shape.

With the arrangement of Laid-open Japanese Utility Model Publication No. Hei 7-22951, an outer container body and an inner container body are joined and fixed together, and a first non-return valve, allowing the passage of contents from the inner container body but preventing the entry of external air into the contents, and a second non-return valve, allowing the passage of external air between the outer container body and the inner container body but preventing the extrusion of external air that has entered between the outer container body and the inner container body, are provided.

Also, a method, wherein a pair of adhesive bands of longitudinal band form, each of which adheres and fixes an outer container body and an inner container body together along the entire height range of a main container body, are provided to restrict deflation of the inner container body to a fixed form with which shrinkage in the height direction does not occur, thereby securing a flow path and smoothening the extrusion operation, is also generally used.

In order to make adhesive bands such as described above function as a means for securing a flow path, it is simple and effective for example to dispose at least two adhesive bands at axially symmetric positions with respect to the central axis of a container body. However in regard to the width dimension of each adhesive band, if the width is too wide, adequate deflation of the inner container body cannot be accomplished, and oppositely if the width is too narrow, the flow path for the contents will become closed by deflation at an early stage, consequently preventing smooth extrusion operation and causing the amount of unused contents to become high.

This invention has thus been made to resolve the above-described problems of the prior art and an object thereof is to provide a squeeze-type extrusion container of excellent extrusion property that enables extrusion operations to be performed smoothly up to the final stage and enable the remaining amount of contents to be lessened.

DISCLOSURE OF INVENTION

Of the means of this invention that resolve the above-described technical problems, the means of the first claim of this invention comprises:

a blow-molded, bottle-shaped, main container body, comprising in turn a separably laminated outer shell layer, forming an outer container body that is squeeze-deformable and has a restoration-enabling flexibility, and inner layer, forming an inner container body that contains contents in its interior and is deflatable inwardly and deformable in a volume-reducing manner by decrease of internal pressure, and an extrusion cap body, having an opening and being fitted to a mouth part of the main container body, the main cap body being provided with a first non-return function part, having a function of preventing the reverse flow of the contents from the opening into the inner container body and the inflow of external air, the outer container body having an external air introduction part for introduction of external air into an interlayer part between the outer shell layer and the inner layer, the external air introduction part being arranged to be in communication with a second non-return function part, having a function of sealing air in the interlayer part during the squeezing process, there being formed at least two adhesive bands of longitudinal band form, each of which adheres and fixes the outer shell layer and the inner layer together along the entire height range while avoiding the external air introduction part, the adhesive band width being set so as to disable complete closure of the plane cross section by free deformation of non-adhered inner layer parts, which are the inner layer parts between the adhesive bands, and the rigidity of the outer shell layer being set so that, in the state where free deformation of the non-adhered inner layer parts reaches a limit due to decrease of the contents and tension acts at the non-adhered inner layer parts and the side end parts of the adhesive bands, the outer shell layer can be deformed by this tension being generated by a normal squeezing operation by a human hand.

With the above-described arrangement of the first claim, since when after the main container body is squeezed and the contents are extruded, the squeezing is stopped and the pressing pressure is released, the outer container body begins restoration to the original shape by an elastic restoring force while the inner container body remains deflated, external air is introduced into the interlayer part between the outer shell layer and the inner layer from the external air introduction part and the outer container body is restored to the original shape.

When from the abovementioned state in which the outer container body has been restored to the original state, squeezing is performed again, since the air in the interlayer part is sealed by the second non-return function part, this air becomes pressurized, thereby causing pressure to be applied to the inner container body and the contents to be extruded.

Since inflow of external air into the inner container body is prevented by the first non-return function part, air will not accumulate inside the inner container body. The contents can thus be extruded simply and rapidly regardless of the orientation of the extrusion container, and problems of decomposition, oxidative degradation, etc., of the contents due to air can also be prevented.

With the arrangement of the first claim, since the adhesive band width is set so that complete closure of the plane cross section by free deformation of the non-adhered inner layer parts will not occur, even when extrusion of the contents by squeezing is repeated and the remaining amount of the contents becomes low, a path for flow of the contents to the exterior can be maintained. Here, free deformation refers to deformation in a state in which tension does not act at the non-adhered inner layer parts and the side end parts of the adhesive bands.

Meanwhile, as the extrusion of the contents by squeezing is repeated and free deformation of the non-adhered inner layer parts progresses, due to the restriction of the length along the circumferential direction of the non-adhered inner layer parts, free deformation becomes constrained at the side end parts of the adhesive bands and tension acts at the non-adhered inner layer parts and the side end parts.

If the rigidity of the outer shell layer is high, the deformation of the outer shell layer for relaxing the above-described tension becomes difficult, and since the non-adhered inner layer parts must be deformed against this tension, further extrusion of the contents by a normal squeezing operation by a human hand becomes difficult.

Though the tension that acts on the non-adhered inner layer parts arises since the outer shell layer is not readily displaced at the vicinity of the adhesive bands that are integrally joined to the inner layer, by setting, as in the arrangement of the first claim, the rigidity of the outer shell layer so that, in the state where tension arises at the side end parts of the adhesive bands, the outer shell layer can be deformed by this tension being generated by a normal squeezing operation by a human hand, the outer shell layer at the vicinity of the adhesive bands is deformed by this tension so as to become indented in the inner direction of the body and the tension that acts on the non-adhered inner layer parts is decreased correspondingly.

By thus decreasing the tension, further extrusion of the contents by a normal squeezing operation by a human hand is enabled.

In this process, the deformation of the outer shell layer is of a deformation mode with which the distance between the side end parts of adjacent adhesive bands is shortened, and even in the state where external air is introduced from the external air introduction part after the squeezing operation, complete restoration from the deformation due to the squeezing operation is not accomplished and the shape becomes that with which the part at the vicinity of the adhesive bands is deformed in the inner direction of the body.

As mentioned above, though when the adhesive band width is set widely to secure a flow path, the deformation of the inner container body becomes difficult in a state at which a considerable amount of the contents is left, with the arrangement of the first claim, by making the outer shell layer deformable correspondingly, smooth extrusion is achieved up to the final stage.

The rigidity of the outer shell layer can be set by selection of material and by the thickness of the outer shell layer, especially, the thickness of the body of the outer shell layer.

Also if the adhesive band width is made too wide, though the rigidity of the outer shell layer must be made correspondingly lower and the deformation of the container becomes large, the adhesive band width and the rigidity of the outer shell layer may be selected in consideration of the viscosity of the contents, squeeze operability, outer appearance, ability of the container to stand upright, hand-held property, etc.

The means of the second claim of this invention is the means of this invention's first claim, wherein the lower limit of the adhesive band width is set so that at least in the limiting state of free deformation of the non-adhered inner layer parts, a flow path for extrusion of the contents to the exterior can be secured by a normal squeezing operation by a human hand.

The flow path for the contents is narrowed gradually by free deformation of the non-adhered inner layer parts and even in a state where there is a leeway in the length of the non-adhered inner layer parts and free deformation is enabled, in a case where the viscosity of the contents is high, the extrusion of the contents by a normal squeezing operation by a human hand, that is, by a normal pressing force can become impossible at an early stage. However with the arrangement of the second claim, the lower limit of the adhesive band width is set so that at least even when free deformation of the non-adhered inner layer parts progresses and the limiting state of free deformation is reached, extrusion will not be made impossible by the narrowing of the flow path, and as long as the container shape, etc., are the same, this limit can be determined mainly from the viscosity of the contents.

The means of the third claim of this invention is the means of this invention's first or second claim, wherein the upper limit of the adhesive band width is set so that the deformation of the outer shell layer will be within a range where the ability of the container to stand upright can be maintained in the limiting state of extrusion of the contents by a normal squeezing operation by a human hand.

Though when the adhesive band width is made wide in order to secure an adequate flow path, the rigidity must be made low and the outer shell layer must be deformed greatly in order to extrude the contents until the remainder is substantially gone, with the arrangement of the third claim, the upper limit of the adhesive band width is set so that the ability of the container to stand upright can be maintained even when the contents are extruded to the extrusion limit.

The means of the fourth claim of this invention is the means of this invention's first, second, or third claim, wherein the plane cross section of the body has a shape having a major axis and a minor axis, which are mutually orthogonal and are respectively bilaterally symmetric axes, and a pair of adhesive bands are positioned substantially axially symmetrically with respect to the central axis of the body at positions near the major axis direction of the plane cross section of the body.

By positioning the adhesive bands as in the above-described arrangement of the fourth claim, the deformation of the non-adhered inner layer parts can be made to proceed as deformation that is substantially vertically and horizontally symmetrical to the major axis and the minor axis, thus enabling the extrusion operation to be performed readily.

The means of the fifth claim of this invention is the means of this invention's fourth claim, wherein the adhesive band width is set to a width of no less than $(1/4)(L-2D1)$ (where D1: major diameter of the plane cross section of the body, L: circumferential length of the plane cross section of the body).

By making the adhesive band width equal to $(1/4)(L-2D1)$, the length of each non-adhered inner layer part becomes equal to the sum of the major diameter of the plane cross section of the body and the width of an adhesive band, and this is exactly the length at which the plane cross section of the body can be closed completely by free deformation of the non-adhered inner layer parts. When the adhesive band width is made less than the above, the length of the non-adhered inner layer parts becomes too long and the flow path becomes closed at a state in which a considerable amount of the contents remain and subsequent extrusion is disabled.

The means of the sixth claim of this invention is the means of this invention's first, second, or third claim, wherein the shape of the plane cross section of the body is made a circular shape and three adhesive bands are positioned at substantially equiangular positions with respect to the central axis of the body.

With the above-described arrangement of the sixth claim, since the plane cross-sectional shape is made a circular shape and three adhesive bands are positioned at equal intervals, and since the plane cross-sectional shape of the container is thus made isotropic to start with and the deformation of the outer shell layer will be substantially isotropic, holding by the hand or a squeezing operation can be carried out without having to be particularly aware of the directionality of the operation and the ability to stand upright can also be maintained more definitely.

The means of the seventh claim of this invention is the means of this invention's sixth claim, wherein the adhesive bandwidth is set to a width of no less than (⅙) D(π−3) (where D: diameter of the plane cross section of the body, π: circumferential ratio).

By making the adhesive band width equal to (⅙)D(π− 3), the length of a non-adhered inner layer part becomes equal to the sum of the diameter of the plane cross section of the body and the width of an adhesive band, and this is exactly the length at which the plane cross section of the body can be closed completely by free deformation of the non-adhered inner layer parts. When the adhesive band width is made less than the above, the length of the non-adhered inner layer parts becomes too long and the flow path becomes closed at a state in which a considerable amount of the contents remain and subsequent extrusion is disabled.

BEST MODE FOR CARRYING OUT THE INVENTION

Figure 1:
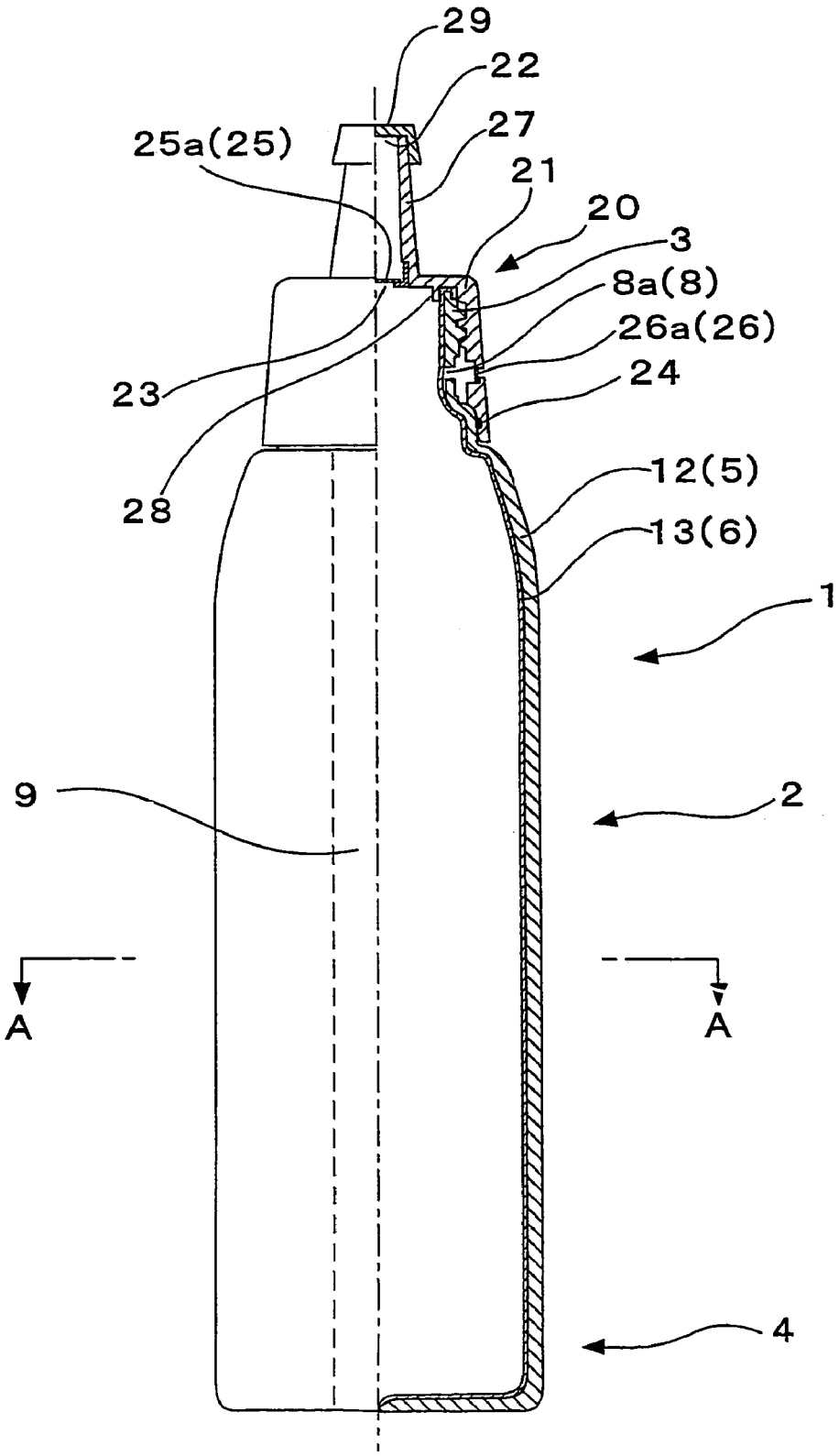
FIG. 1 is a longitudinal semi-sectional view showing a first embodiment of this invention's extrusion container.

Embodiments of this invention shall now be described with reference to the drawings.

FIGS. 1 through 6 show a first embodiment of an extrusion container by this invention, and this extrusion container comprises a main container body 1 and an extrusion cap body 20 with main container body 1 in turn comprising an outer shell layer 5, made of a low-density polyethylene resin, and an inner layer 6, made of an eval resin (made by Kuraray Co., Ltd.), which is an ethylene vinyl alcohol copolymer that is low in compatibility with the low-density polyethylene resin, and two adhesive bands 9 of longitudinal band form that adhere outer shell layer 5 and inner layer 6 together are formed along the entire height range from an adhesive resin that exhibits adequate adhesion to the low-density polyethylene resin and the eval resin.

The resins used for outer shell layer 5 and inner layer 6 are not restricted to low-density polyethylene resin and eval resin, and resins that are mutually low in compatibility may be selected and used according to the purpose.

Main container body 1 has a bottle form comprising a bottom part 4, a body 2, which is connected to bottom part 4 and has an oval plane cross section, and a cylindrical mouth part 3, which is erected from and connected to the upper end of body 2.

The height of main container body 1 is 160 mm, the sectional shape of body 2 is an oval shape with a major diameter D1 of 70 mm and a minor diameter of 50 mm (both indicated as inner diameters), and the average thickness of outer shell layer 5 at body 2 is 1.0 mm.

With the exception of the parts that are adhered and fixed together by adhesive bands 9, outer shell layer 5 and inner layer 6 that make up main container body 1 are separably laminated, with outer shell layer 5 forming an outer container body 12, having adequate mechanical strength and squeeze-deformability and a flexibility that enables restoration from deformation, and inner layer 6 forming a thin inner container body 13, which can exhibit adequate deflation, at the inner side of outer container body 12.

Figure 2:
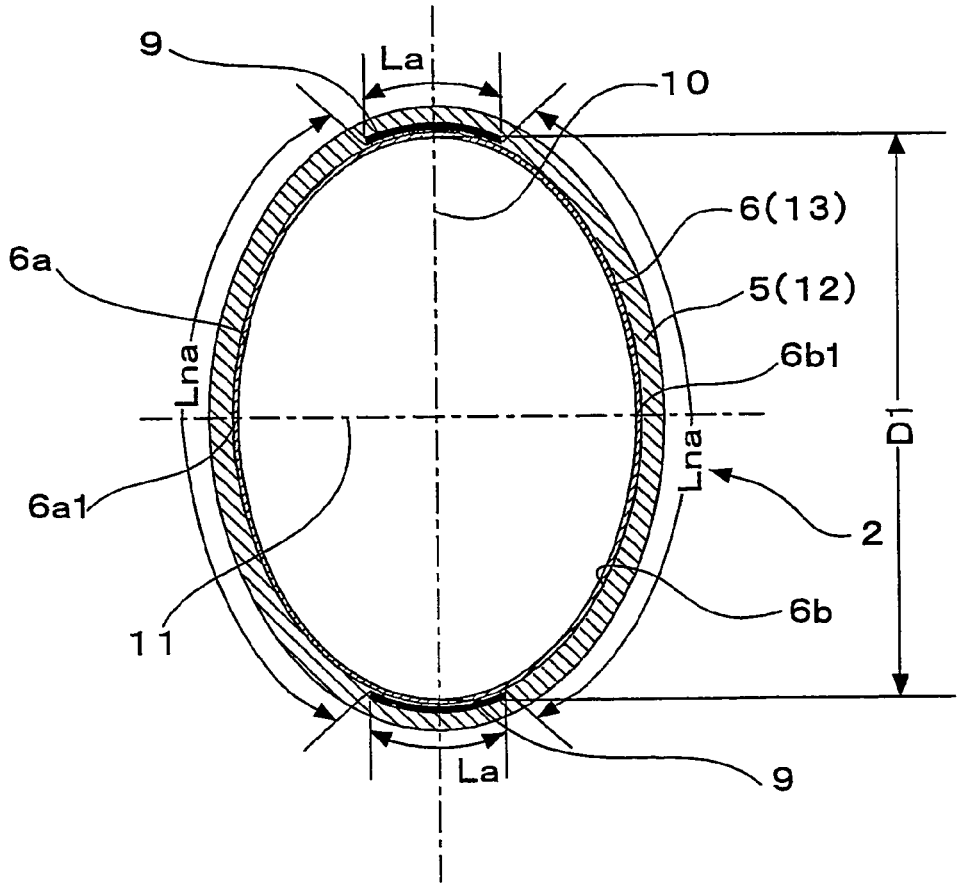
FIG. 2 is a plane cross-sectional view along line A—A of the first embodiment shown in FIG. 1.

FIG. 2 shows a plane cross-sectional view of body 2, and here, adhesive bands 9, which adhere and fix outer shell layer 5 and inner layer 6 together, are formed as a pair along the entire height range of main container body 1 in an axially symmetrical manner with respect to the central axis of body 2 and at positions in the major axis 10 direction of the oval plane cross section of body 2. With the present embodiment, the circumferential length L of the body is 190 mm, the width La of adhesive band 9 is set to 20 mm, and the length Lna in the circumferential direction of each of non-adhered inner layer parts 6*a* and 6*b* is 75 mm. The width of adhesive band 9 as calculated from (¼)(L−2D1) is 12.5 mm.

Figure 4:
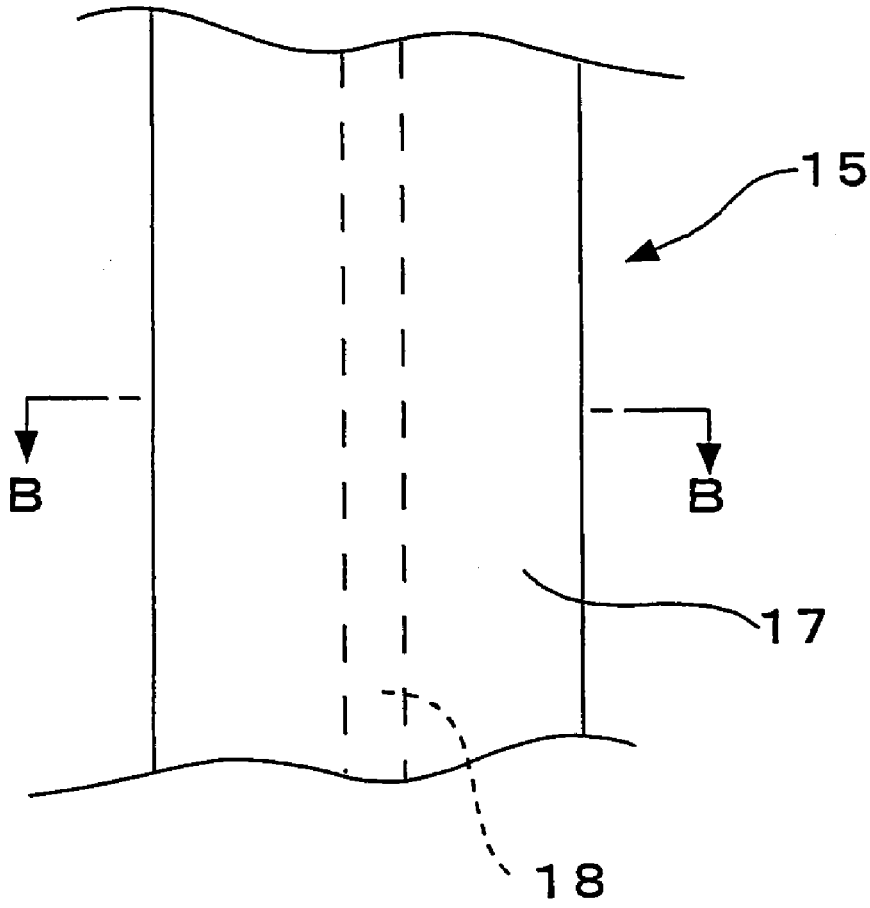
FIG. 4 is a front view showing an embodiment of a parison that is blow molded to a main container body of this invention.
Figure 5:
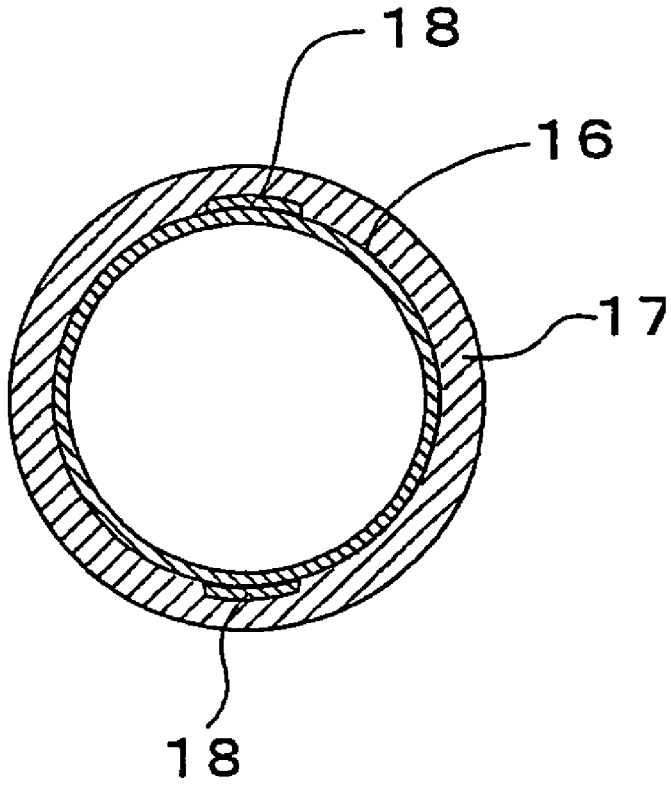
FIG. 5 is plane cross-sectional view along line B—B of the parison embodiment shown in FIG. 4.

As shown in FIGS. 4 and 5, for blow molding of this main container body 1, a parison 15 is molded by coextrusion of an outer cylinder 17, made of the low-density polyethylene resin, an inner cylinder 16, made of the eval resin and positioned at the inner side of outer cylinder 17, and adhesive layers 18, comprising a pair of narrow-band-form adhesive resin between outer cylinder 17 and inner cylinder 16 and at axially symmetrical positions with respect to the central axis, and this parison 15 is molded by a split mold for blow molding.

Figure 3:
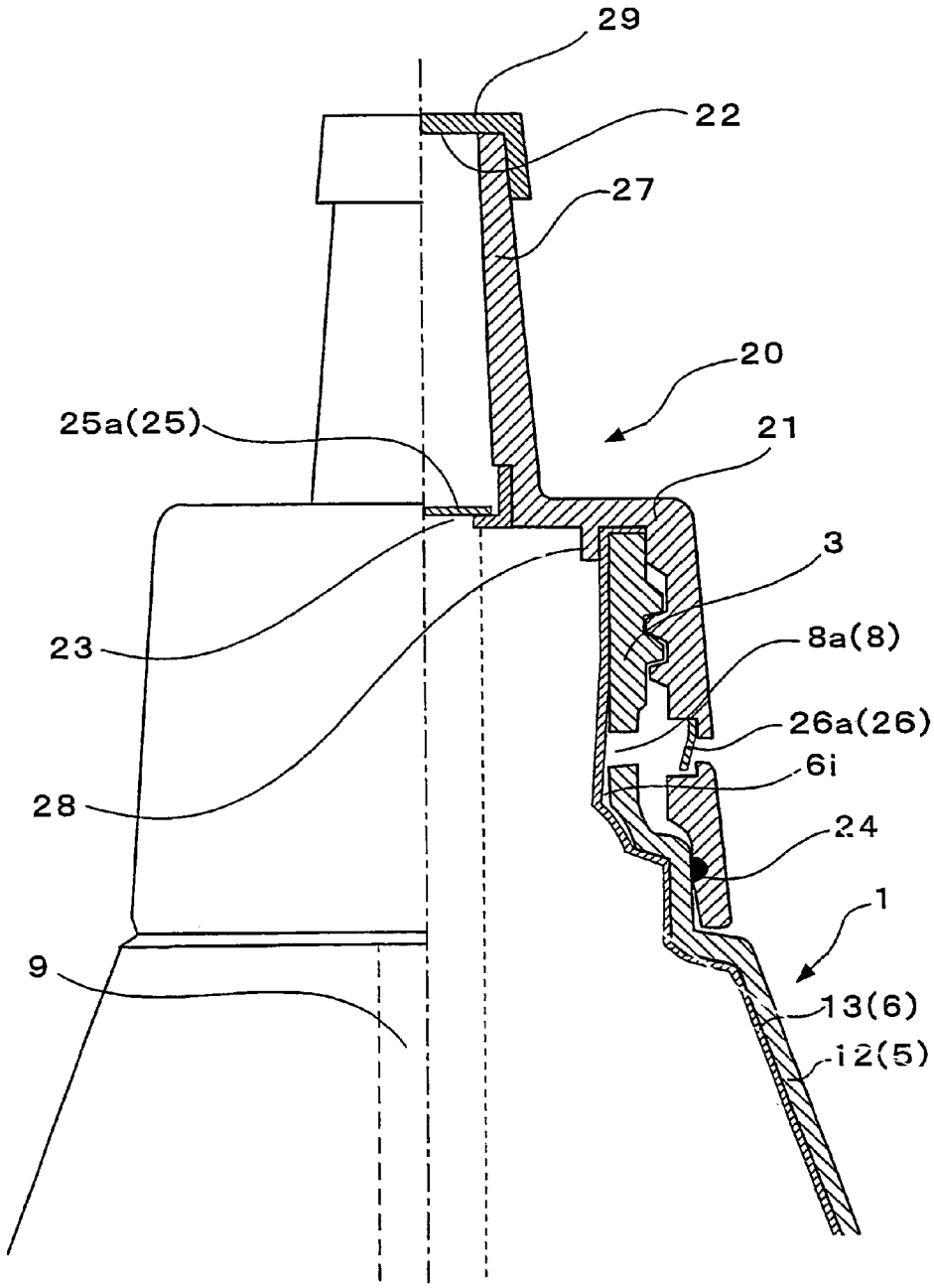
FIG. 3 is an enlarged longitudinal semi-sectional view of the principal parts of the first embodiment shown in FIG. 1.

The cylindrical mouth part 3 has a thread formed on its outer circumferential surface and has a pair of external air introduction holes 8*a*, which are a form of external air introduction part 8, opened at axially symmetric positions with respect to the central axis of body 2 that are offset by 90° from adhesive bands 9 (see FIG. 3).

Extrusion cap body 20 has a main cap body 21, having the form of a topped cylinder with a top wall provided with an opening 23 at a central part and having a thread, for engagement with mouth part 3 of main container body 1, formed on the inner circumferential surface, and an extrusion cylinder 27, which is erected from and connected to the opening edge of opening 23 at the upper surface of the top wall of main cap body 21, and is arranged so that the contents are extruded to the exterior from the extrusion port 22 at the tip of extrusion cylinder 27. Extrusion port 22 is capped by a cover cap 29.

Extrusion cap body 20 is assembled by screwing onto mouth part 3 of main container body 1, and sealing is accomplished by sealing cylinder part 28, protruding downwards from the lower face of the top wall of main cap body 21 and the sealing part 24, attached to the lower end of the inner peripheral surface, being put in close contact to the upper end of the inner peripheral surface and the lower end of the outer peripheral surface, respectively, of mouth part 3 of main container body 1.

Extrusion cap body 20 has a first non-return function part 25, having a first non-return valve 25*a*, installed at opening 23 of main cap body 21 and this provides a non-return function of normally closing opening 23 and preventing the entry of external air and a function of becoming opened by the internal pressure of inner container 13 when contents 7 are to be extruded by the squeezing of main container body 1 and thereby opening the opening 23.

Extrusion cap body 20 also has a second non-return function part 26, having a second non-return valves 26*a* attached at two locations of the cylinder wall of main cap body 21 that are matched with the external air introduction holes 8*a* provided in mouth part 3, and these provide a function of opening when the pressure of the air between outer container body 12 and inner container body 13 becomes lower than that of the external air and thereby introducing air into interlayer parts 6*i* between outer shell layer 5 and inner layer 6 via external air introduction holes 8*a* and, oppositely, a non-return function of closing and preventing the release of the air to the exterior when the pressure of the air between outer container body 12 and inner container body 13 becomes equal to that of the external air.

The usage states of the extrusion container of the above-described embodiment shall now be described. With the extrusion container arranged as described above, when main container body 1 is squeezed, second non-return valves 26*a* close, the pressure of the contents contained in inner container body 13 rises, thereby opening first non-return valve 25*a*, the contents are extruded to the exterior from extrusion port 22 at the tip of extrusion cap body 20, and inner container body 13 is decreased in volume and deformed by an amount corresponding to the decrease of contents 7.

Thereafter, when the squeezing of main container body 1 is stopped and the pressing pressure is released, outer container body 12 begins to be restored to its original shape by its elastic restoring force, the air between outer container body 12 and inner container body 13 becomes depressurized, and as a result, internal pressure of inner container body 13 returns to the external air pressure, first non-return valve 25*a* closes, the extrusion of contents 7 stops, and while the deflated shape of inner container body 13 is maintained, second non-return valves 26*a* open, causing air from the exterior to be introduced via external air introduction holes 8*a* into interlayer parts 6*i* between outer shell layer 5 and inner layer 6, and when outer container body 12 returns to its original shape and the pressure of the air between outer container body 12 and inner container body 13 becomes equal to that of the exterior, second non-return valves 26*a* close. In this process, the separation of outer shell layer 5 and inner layer 6 progresses.

When main container body 1 is squeezed again, since second non-return valves 26*a* are still closed, the pressure due to squeezing is transmitted to inner container body 13 via the air between outer container body 12 and inner container body 13, causing the internal pressure of inner container body 13 to rise, first non-return valve 25*a* to open, contents 7 to be extruded from extrusion port 22, and inner container body 13 to decrease in volume and deform further by the corresponding amount, and when the squeezing of main container body 1 is stopped and pressing pressure is released, the same as the above occurs, and by the repeating of the extrusion process in the above-described manner, the extrusion of contents 7 is repeated.

Figure 6:
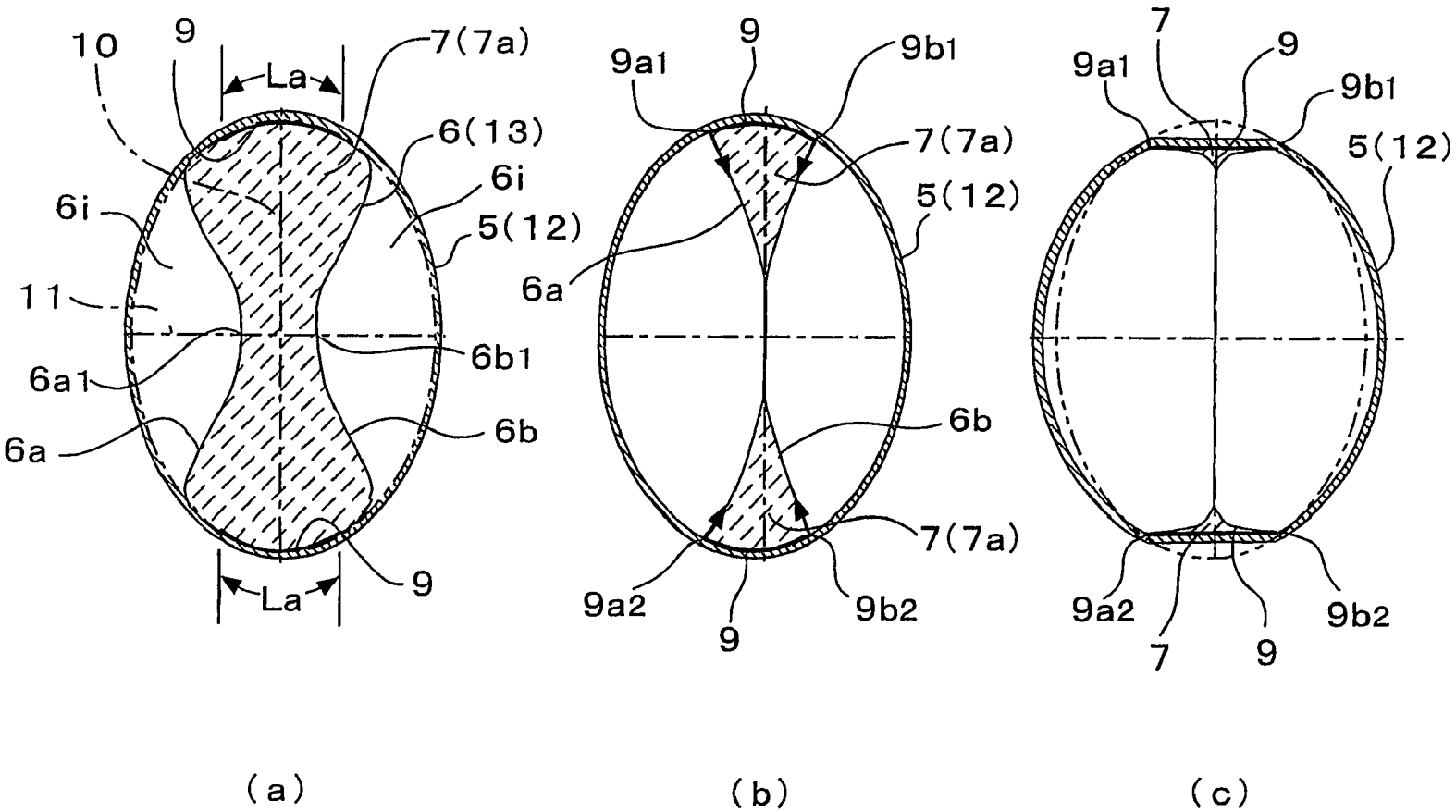
FIG. 6 shows explanatory diagrams showing the transition of deformation of the outer shell layer and the inner layer in the plane cross-sectional view shown in FIG. 2 for the first embodiment of this invention's extrusion container.

FIG. 6 shows plane cross-sectional views of body 2 of this embodiment's extrusion container that are explanatory diagrams illustrating the transition of deformation of outer shell layer 5 (outer container body 12) and inner layer 6 (inner container body 13). As viewed with the plane cross-sectional views, in an ideal case of progress of the free deformation of non-adhered inner layer parts 6*a* and 6*b* in accompaniment with the extrusion of contents 7, first, the central parts 6*a*1 and 6*b*1 of non-adhered inner layer parts 6*a* and 6*b*, which are partitioned into two in the left and right directions by adhesive bands 9, are freely deformed to flattened forms (see FIG. 6(*a*)).

As free deformation progresses further, the vicinities of the central parts 6*a*1 and 6*b*1 of both of non-adhered inner layer parts 6*a* and 6*b* contact each other, substantially along major axis 10.

As free deformation progresses further, due to the dimensional limit of the length Lna, non-adhered inner layer parts 6*a* and 6*b* reach states where there are hardly any more freely deformable parts and become constrained at two locations, respectively, by the side end parts 9*a*1 and 9*a*2 and 9*b*1 and 9*b*2. A state in which tension acts between non-adhered inner layer parts 6*a* and 6*b* and side end parts 9*a*1, 9*a*2, 9*b*1, and 9*b*2 of adhesive bands 9 is thus entered and further free deformation is disabled (see FIG. 6(*b*)).

The arrows in FIG. 6(*b*) indicate the directions of the forces that act on side end parts 9*a*1, 9*a*2, 9*b*1, and 9*b*2 of adhesive bands 9.

Since the width of each adhesive band 9 is set adequately greater than the value calculated by (¼)(L−2D1), complete closure of the plane cross section does not occur at any height of body 2 at this stage, and furthermore, for a viscosity of approximately that of mayonnaise, for example, a flow path 7*a* is adequately secured in this state.

However, even in a state where an adequate flow path 7*a* is secured, if in the state in which tension acts as described above, outer shell layer 5 is high in rigidity and difficult to deform, it will be difficult to deflatingly deform inner container body 13 and extrude contents 7 by squeezing by a normal operation by a hand.

Here, by forming outer shell layer 5 from a low-density polyethylene resin, making the average thickness 1.0 mm, and thus making the rigidity comparatively low as in the present first embodiment, the outer shell layer 5 in the vicinity of adhesive bands 9 can be made to deform in an indenting manner towards the inner direction of body 2 by the tension that acts on non-adhered inner layer parts 6*a* and 6*b* and side end parts 9*a*1, 9*a*2, 9*b*1, and 9*b*2 so that major diameter 10 is shortened, non-adhered inner layer parts 6*a* and 6*b* are provided with allowance for free deformation, and extrusion can be made to progress readily until substantially all of contents 7 are gone (see FIG. 6(*c*)).

Also, though even if the pressing pressure is released after squeezing, outer shell layer 5 will not return completely to its original shape and will be of a shape that is deformed as described above, the degree of this deformation is within a range that does not present a problem in terms of the ability of the container to stand upright and in terms of the ability to perform a normal squeezing operation by a hand.

Though the present embodiment is an example wherein a pair of adhesive bands 9 are formed axially symmetrically in the direction of major axis 10 of an oval, the positioning of this pair of adhesive bands 9 at positions that are slightly shifted from the major axis 10 direction may be effective in some cases, and there is no need for the positions to be strictly axially symmetric. Furthermore, besides an oval shape, a shape such as an elliptical shape, a flat rhombic shape, etc., may also be used.

Figure 7:
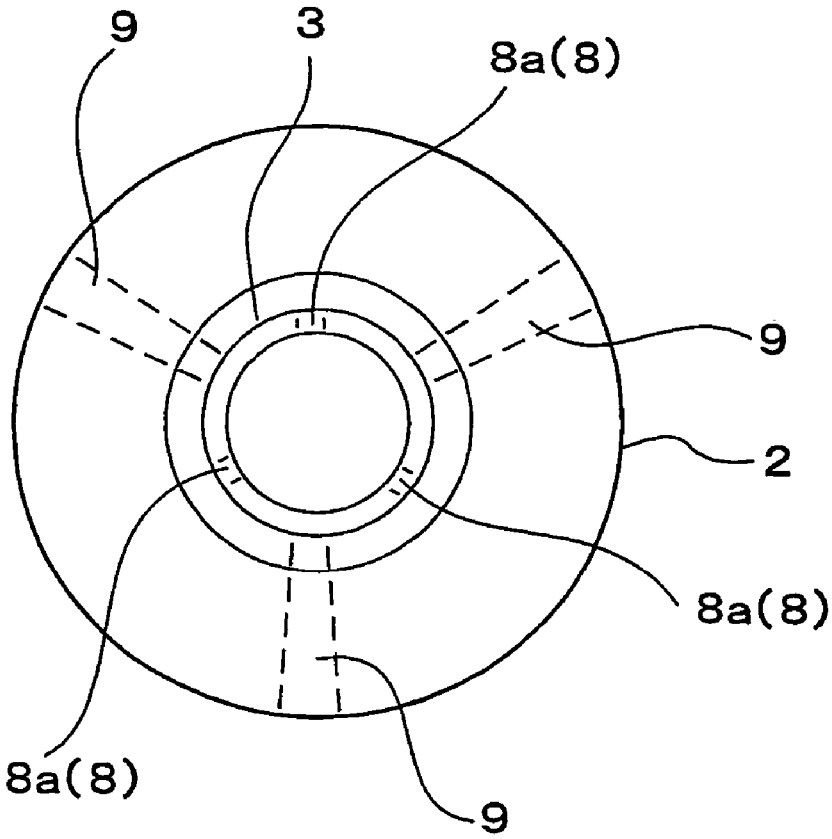
FIG. 7 is a plan view showing a main container body of a second embodiment of this invention's extrusion container.
Figure 8:
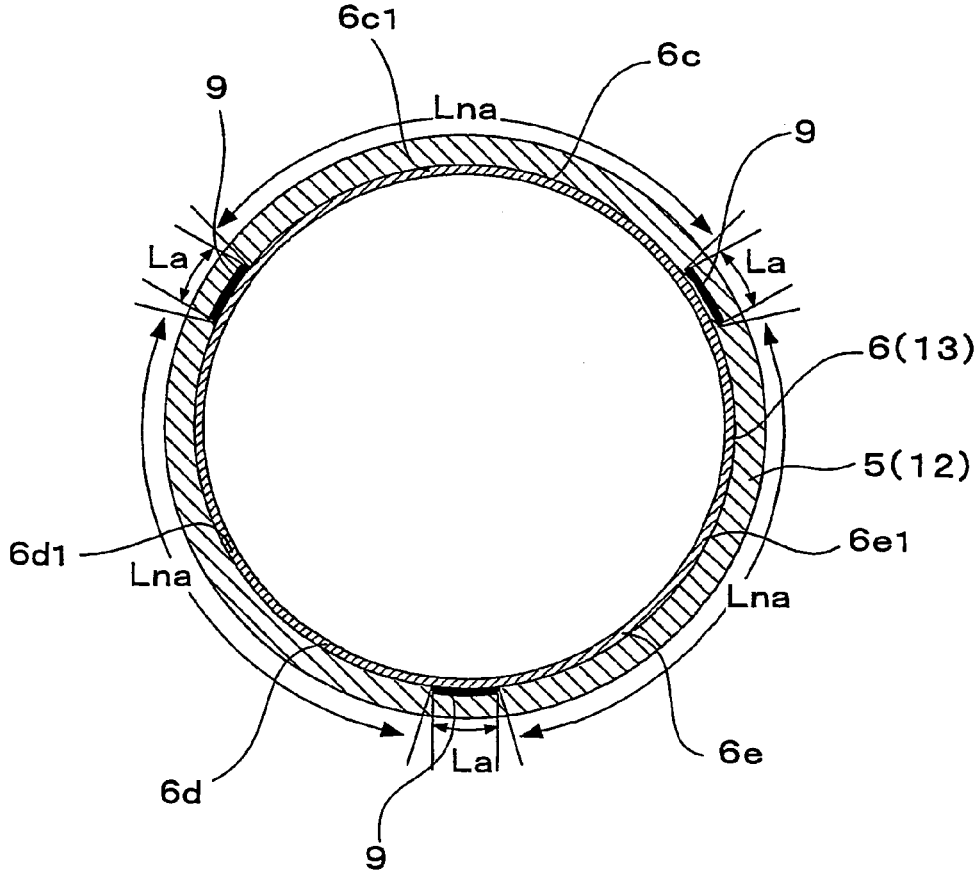
FIG. 8 is a plane cross-sectional view showing the main container body of the second embodiment of this invention's extrusion container being cut at substantially the central height position of the body.
Figure 9:
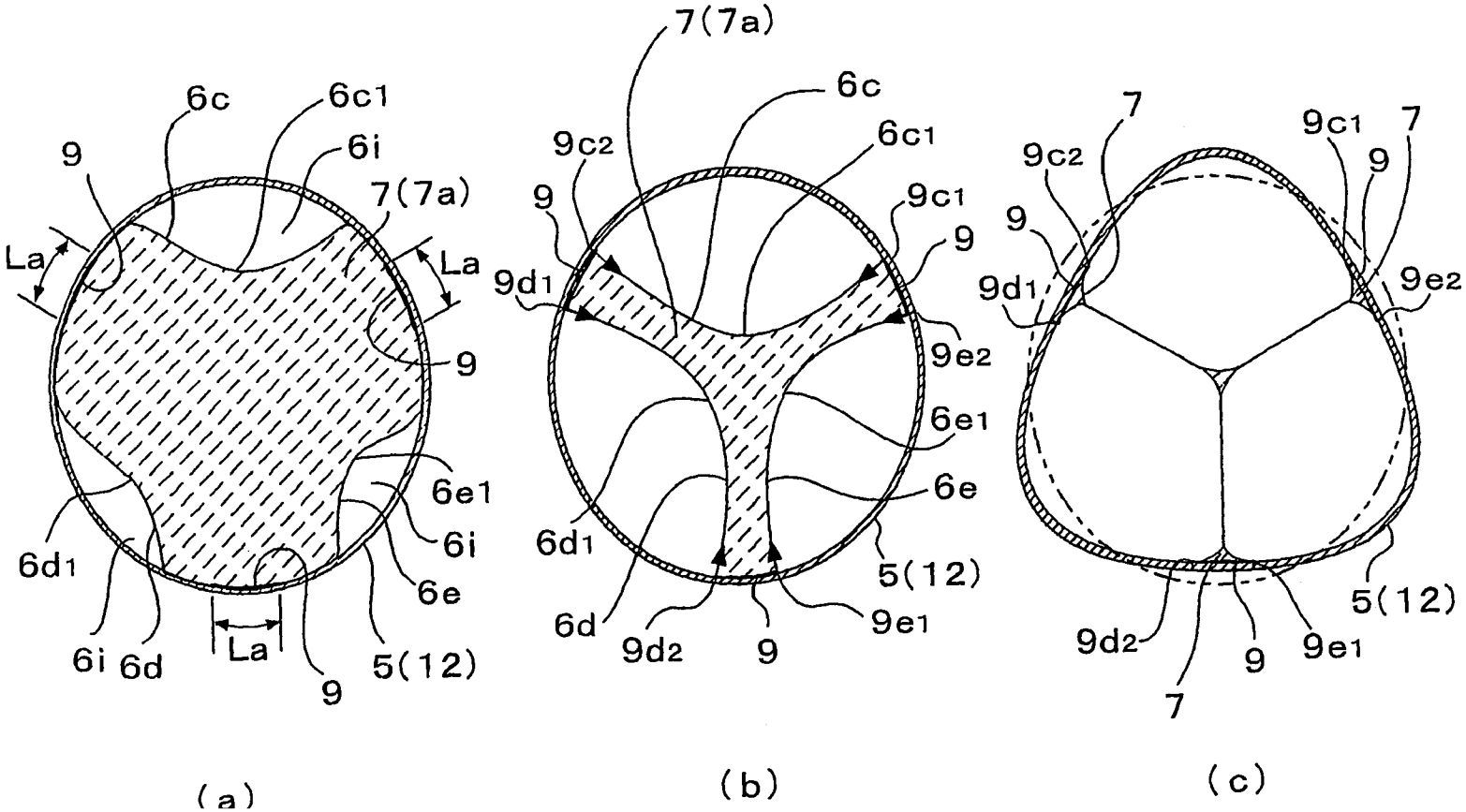
FIG. 9 shows explanatory diagrams showing the transition of deformation of the outer shell layer and the inner layer in the plane cross-sectional view shown in FIG. 8 for the second embodiment of this invention's extrusion container.

FIGS. 7 to 9 show a second embodiment of this invention's extrusion container.

This extrusion container of the second embodiment of this invention is the same in arrangement as the first embodiment with the exceptions that the sectional shape of body 2, which shall be described in detail below, is a circular shape, three adhesive bands 9 are formed, and in correspondence to these three adhesive bands 9, external air introduction holes 8*a* are opened at three locations of mouth part 3 and second non-return function part 26 has second non-return valves 26*a* attached to three locations of the cylindrical wall of main cap body 21.

Main container body 1 has a height of 160 mm, body 2 has a circular plane cross-sectional shape with a diameter D (inner diameter) of 55 mm, outer shell layer 5, inner layer 6, and adhesive bands 9 are respectively formed from the same resins as those of the first embodiment, and the average thickness of outer shell layer 5 at body 2 is 1.0 mm.

FIG. 8 shows a plane cross-sectional view of main container body 1 as sectioned at substantially the central height position of body 2. Three adhesive bands 9, each of which adheres and fixes outer shell layer 5 and inner layer 6 together, are formed along the entire height range of main container body 1 so as to be at the same angle (120°) with respect to the central axis of body 2, the width La of each adhesive band 9 is set to 5 mm, and the length Lna of each of non-adhered inner layer parts 6*c*, 6*d*, and 6*e* is approximately 53 mm. The adhesive band width La as calculated by $(1/6)D(\pi-3)$ is approximately 1.3 mm.

Mouth part 3 has a thread formed on its outer circumferential surface and has three external air introduction holes 8*a*, which are a form of external air introduction part 8, opened at three positions that are offset by 60° from adhesive bands 9 with respect to the central axis of body 2, that is, three positions positioned intermediate the adhesive bands 9 (see FIG. 7).

Extrusion cap body 20 has second non-return function part 26 of the structure illustrated with the first embodiment attached to three locations that are matched with the positions of external air introduction holes 8*a* formed in mouth 3, and besides this, is the same in arrangement as the first embodiment (illustration is omitted).

The blow molding of this main container body 1 is performed in the same manner as in the first embodiment (see FIGS. 4 and 5) with the exception that three adhesive layers 18, each formed of a band-shaped adhesive resin, are coextruded so as to be positioned at an equal central angle (120°) with respect to the central axis of a parison 15.

As with FIG. 6 of the first embodiment, FIG. 9 shows plane cross-sectional views of body 2 shown in FIG. 8 that are explanatory diagrams illustrating the transition of deformation of outer shell layer 5 (outer container body 12) and inner layer 6 (inner container body 13) of the extrusion container of the second embodiment. As viewed with the plane cross-sectional views, in an ideal case of progress of the free deformation of non-adhered inner layer parts 6*c*, 6*d*, and 6*e* in accompaniment with the extrusion of contents 7, first, the central parts 6*c*1, 6*d*1, and 6*e*1 of non-adhered inner layer parts 6*c*, 6*d*, and 6*e*, which are partitioned into three by the three adhesive bands 9, are freely deformed to flattened forms (see FIG. 9(*a*)).

Free deformation progresses further with central parts 6*c*1, 6*d*1, and 6*e*1 approaching the center of body 2.

As free deformation progresses further, due to the dimensional limit of the length Lna of each non-adhered inner layer part, non-adhered inner layer parts 6*c*, 6*d*, and 6*e* reach states where there are hardly any more freely deformable parts and become constrained at two locations, respectively, by the side end parts 9*c*1 and 9*c*2, 9*d*1 and 9*d*2, and 9*e*1 and 9*e*2. A state in which tension acts between non-adhered inner layer parts 6*c*, 6*d*, and 6*e* and side end parts 9*c*1, 9*c*2, 9*d*1, 9*d*2, 9*e*1, and 9*e*2 of adhesive bands is thus entered and further free deformation is disabled (see FIG. 9(*b*)).

The arrows in FIG. 9(*b*) indicate the directions of the forces that act on side end parts 9*c*1, 9*c*2, 9*d*1, 9*d*2, 9*e*1, and 9*e*2 of adhesive bands 9.

Since the width of each adhesive band 9 is set adequately greater than the value calculated by $(1/6)D(\pi-3)$, complete closure of the plane cross section does not occur at any height of body 2 at this stage, and furthermore, for a viscosity of approximately that of mayonnaise, for example, a flow path 7*a* is adequately secured in this state.

Here, as with the first embodiment, by forming outer shell layer 5 from a low-density polyethylene resin, making the average thickness 1.0 mm, and thus making the rigidity comparatively low, the outer shell layer 5 in the vicinity of adhesive bands 9 can be made to deform in an indenting manner towards the inner direction of body 2 by the tension that acts on non-adhered inner layer parts 6*c*, 6*d*, and 6*e* and side end parts 9*c*1, 9*c*2, 9*d*1, 9*d*2, 9*e*1, and 9*e*2 of adhesive bands 9 so that non-adhered inner layer parts 6*c*, 6*d*, and 6*e* are provided with allowance for free deformation and extrusion can be made to progress readily until substantially all of contents 7 are gone (see FIG. 9(*c*)).

Also, by making the plane cross section circular in shape and positioning three adhesive bands 9 at equiangular positions, the shape of outer container body 12 will be isotropic even after deformation as shown in FIG. 9(*c*), thus providing a container that is easy to handle in terms of the ability of the container to stand upright and in terms of the ability to hold the container by a hand in the squeezing process.

EFFECTS OF THE INVENTION

Due to being provided with the above arrangements, this invention provides the following effects.

With the invention of the first claim, though when the width of the adhesive band is set widely to secure a flow path, the deformation of the inner container body becomes difficult in a state at which a considerable amount of the contents is left, since the outer shell layer is made deformable correspondingly, an extrusion container, which exhibits good extrusion operability up to a point at which the contents are substantially gone, can be provided.

With the invention of the second claim, the lower limit of the adhesive band width is set so that extrusion will not be disabled by the narrowing of the flow path, and good extrusion property can thus be maintained even for contents of high viscosity.

With the invention of the third claim, the ability of the container to stand upright will not be lowered even after deformation of the outer shell layer.

With the invention of the fourth claim, by making the plane cross section of the body be of a shape having a major axis and a minor axis, which are mutually orthogonal and are respectively bilaterally symmetric axes, and by positioning a pair of adhesive bands substantially axially symmetrically with respect to the central axis of the body at positions near the major axis direction of the plane cross section of the body, the deformation of the non-adhered inner layer parts can be made to proceed as deformation that is substantially vertically and horizontally symmetrical to the major axis and the minor axis, thus enabling the extrusion operation to be performed readily.

With the invention of the fifth claim, by setting the adhesive band width in the fourth claim to a width of no less than (¼)(L−2D1), closure of the flow path in a state in which a considerable amount of contents remains can be prevented.

With the invention of the sixth claim, by making the shape of the plane cross section of the body a circular shape and positioning three adhesive bands at substantially equiangular positions with respect to the central axis of the body, the container itself and the deformation of the outer shell layer are made substantially isotropic, thus enabling holding by the hand or a squeezing operation to be carried out without having to be particularly aware of the directionality of the operation and enabling the ability to stand upright to be maintained more definitely.

With the invention of the seventh claim, by setting the adhesive band width in the sixth claim to a width of no less than (⅙)D(π−3), closure of the flow path in a state in which a considerable amount of contents remains can be prevented.

What is claimed is:

1. An extrusion container comprising:

a blow-molded, bottle-shaped, main container body, comprising:

in turn, a separably laminated outer shell layer, forming an outer container body that is squeeze-deformable and has a restoration-enabling flexibility, and inner layer, forming an inner container body that contains contents in its interior and is deflated inwardly and deformed in a volume-reducing manner by decrease of internal pressure, and an extrusion cap body, having an opening and being fitted to a mouth part of said main container body, where said extrusion cap body is provided with a first non-return function part, having a function of preventing the reverse flow of the contents from said opening into the inner container body and the inflow of external air, and said outer container body has an external air introduction part for introduction of external air into an interlayer part between said outer shell layer and inner layer, said external air introduction part being arranged to be in communication with a second non-return function part, having a function of sealing air in the interlayer part during the squeezing process, and at least two adhesive bands of longitudinal band form, each of which adheres and fixes said outer shell layer and inner layer together along the entire height range while avoiding the external air introduction part, wherein the width of each of said adhesive bands is set so as to disable complete closure of the plane cross section by free deformation of non-adhered inner layer parts, which are the inner layer parts between said adhesive bands, and wherein the rigidity of the outer shell layer is set so that, in the state where free deformation of said non-adhered inner layer parts reaches a limit due to decrease of the contents and tension acts at said non-adhered inner layer parts and the side end parts of the adhesive bands, the outer shell layer is deformed in a region of the adhesion bands in a direction toward the interior of said main container body by tension generated by further normal squeezing operation by a human hand, to reduce a volume of a contents passage formed between the inner layer in the region of the adhesion bands and said non-adhered inner layer parts.

2. The extrusion container as set forth in claim 1, wherein the lower limit of the adhesive band width is set so that at least in the limiting state of free deformation of the non-adhered inner layer parts, a flow path for extrusion of the contents to the exterior can be secured by a normal squeezing operation by a human hand.

3. The extrusion container as set forth in claim 1, wherein the upper limit of the adhesive band width is set so that the deformation of the outer shell layer will be within a range where the ability of the container to stand upright can be maintained in the limiting state of extrusion of the contents by a normal squeezing operation by a human hand.

4. The extrusion container as set forth in claim 1, wherein the plane cross section of the body has a shape having a major axis and a minor axis, which are mutually orthogonal and are respectively bilaterally symmetric axes, and a pair of adhesive bands are positioned substantially axially symmetrically with respect to the central axis of said body at positions near the major axis direction of the plane cross section of said body.

5. The extrusion container as set forth in claim 4, wherein the width of each adhesive band is set to a width of no less than (¼)(L−2D1) (where D1: major diameter of the plane cross section of the body, L: circumferential length of the plane cross section of the body).

6. The extrusion container as set forth in claim 1, wherein the shape of the plane cross section of the body is made a circular shape and three adhesive bands are positioned at substantially equiangular positions with respect to the central axis of the body.

7. The extrusion container as set forth in claim 6, wherein the width of each adhesive band is set to a width of no less than (⅙) D(π−3) (where D: diameter of the plane cross section of the body).

8. The extrusion container as set forth in claim 2, wherein the upper limit of the adhesive band width is set so that the deformation of the outer shell layer will be within a range where the ability of the container to stand upright can be maintained in the limiting state of extrusion of the contents by a normal squeezing operation by a human hand.

9. The extrusion container as set forth in claim 2, wherein the plane cross section of the body has a shape having a major axis and a minor axis, which are mutually orthogonal and are respectively bilaterally symmetric axes, and a pair of adhesive bands are positioned substantially axially symmetrically with respect to the central axis of said body at positions near the major axis direction of the plane cross section of said body.

10. The extrusion container as set forth in claim 3, wherein the plane cross section of the body has a shape having a major axis and a minor axis, which are mutually orthogonal and are respectively bilaterally symmetric axes, and a pair of adhesive bands are positioned substantially axially symmetrically with respect to the central axis of said body at positions near the major axis direction of the plane cross section of said body.

11. The extrusion container as set forth in claim 2, wherein the shape of the plane cross section of the body is made a circular shape and three adhesive bands are positioned at substantially equiangular positions with respect to the central axis of the body.

12. The extrusion container as set forth in claim 3, wherein the shape of the plane cross section of the body is made a circular shape and three adhesive bands are positioned at substantially equiangular positions with respect to the central axis of the body.

* * * * *

UNITED STATES PATENT AND TRADEMARK OFFICE

CERTIFICATE OF CORRECTION

PATENT NO. : 6,981,617 B2 
DATED : January 3, 2006
INVENTOR(S) : Hiroyuki Nakamura, Masashi Yoneyama and Takayuki Goto It is certified that error appears in the above-identified patent and that said Letters Patent is hereby corrected as shown below:

Column 5,
Line 16, should read -- band width is set to a width of no less than (1/6)D(π-3) --.

Column 12,
Line 42, should read -- than (1/6)D(π-3) (where D: diameter of the plane cross --.

Signed and Sealed this

Eleventh Day of April, 2006

JON W. DUDAS
*Director of the United States Patent and Trademark Office*